US007018181B2

(12) United States Patent
Cooper et al.

(10) Patent No.: US 7,018,181 B2
(45) Date of Patent: Mar. 28, 2006

(54) SWASHPLATE PUMP

(75) Inventors: Robert D. Cooper, Elk River, MN (US); Scott R. Carpenter, Rogers, MN (US)

(73) Assignee: Wagner Spray Tech Corporation, Minneapolis, MN (US)

( * ) Notice: Subject to any disclaimer, the term of this patent is extended or adjusted under 35 U.S.C. 154(b) by 336 days.

(21) Appl. No.: 10/427,447

(22) Filed: May 1, 2003

(65) Prior Publication Data

US 2004/0219030 A1 Nov. 4, 2004

(51) Int. Cl.
*F04B 37/00* (2006.01)
*F01B 3/00* (2006.01)

(52) U.S. Cl. ..... 417/470; 92/71; 92/140; 74/66

(58) Field of Classification Search ..... 417/269, 417/470; 92/71, 140, 130 B, 130 C; 74/66
See application file for complete search history.

(56) References Cited

U.S. PATENT DOCUMENTS 2,672,095 A 3/1954 Lucien et al.
3,636,820 A * 1/1972 Lambeth ..... 91/499
3,680,981 A 8/1972 Wagner
RE29,055 E 11/1976 Wagner
4,403,924 A 9/1983 Gebauer et al.
5,032,061 A * 7/1991 Porel ..... 417/270
5,107,960 A * 4/1992 Below ..... 184/6.16
5,490,444 A 2/1996 Claas
5,647,266 A 7/1997 Claas
5,784,948 A 7/1998 Chrestoff et al.
5,794,513 A 8/1998 Kristensen
6,053,091 A * 4/2000 Tojo ..... 92/71
6,283,009 B1 * 9/2001 Hayashi et al. ..... 92/71

* cited by examiner

*Primary Examiner*—Charles G. Freay
(74) *Attorney, Agent, or Firm*—Faegre & Benson, LLP

(57) ABSTRACT

A piston pump assembly with a rotatingly driven swashplate in driving relationship with a rocker arm and piston engaged with one end of the rocker arm. A spring urges the rocker arm and piston into contact with an annular ring carried by a bearing in the swashplate. The spring may be a separate leaf spring or may be formed integrally with the rocker arm. The rocker arm engagement with the piston uses a spherical ball-joint-like surface. The contact between each of the rocker arm and piston and the annular ring utilize spherical surfaces on the rocker arm and piston, with an elongated footprint on the rocker arm and a circular footprint on the piston. The piston is allowed a slight radial play in operation.

27 Claims, 21 Drawing Sheets

SWASHPLATE PUMP

CROSS REFERENCE TO RELATED APPLICATIONS

Reference is made to the following copending and commonly assigned United States Patent Applications by the same inventors, each of which was filed on the same day as the instant application, and each of which is hereby expressly incorporated by reference:

i) STRAINER AND VALVE RELEASE, Ser. No. 10/427,446; and ii) FAN BAFFLE, Ser. No. 10/427,448.

FIELD OF THE INVENTION

This invention relates to the field of pumps for paint and related coating materials.

BACKGROUND OF THE INVENTION

In the past, various forms of pumps have been used to deliver paint (or other similar coating material) to a spray gun for atomization in airless spraying. Such pumps have included piston pumps, where the pistons have been driven using a variety of mechanisms, such as eccentric cams, scotch yokes, or cranks and connecting rods to convert rotary to linear motion. Each of these approaches have suffered from various drawbacks, both technical and economic.

The present invention overcomes shortcomings of the prior art by using a unique mechanism in an assembly which is both technically and economically efficient.

DETAILED DESCRIPTION

Figure 1:
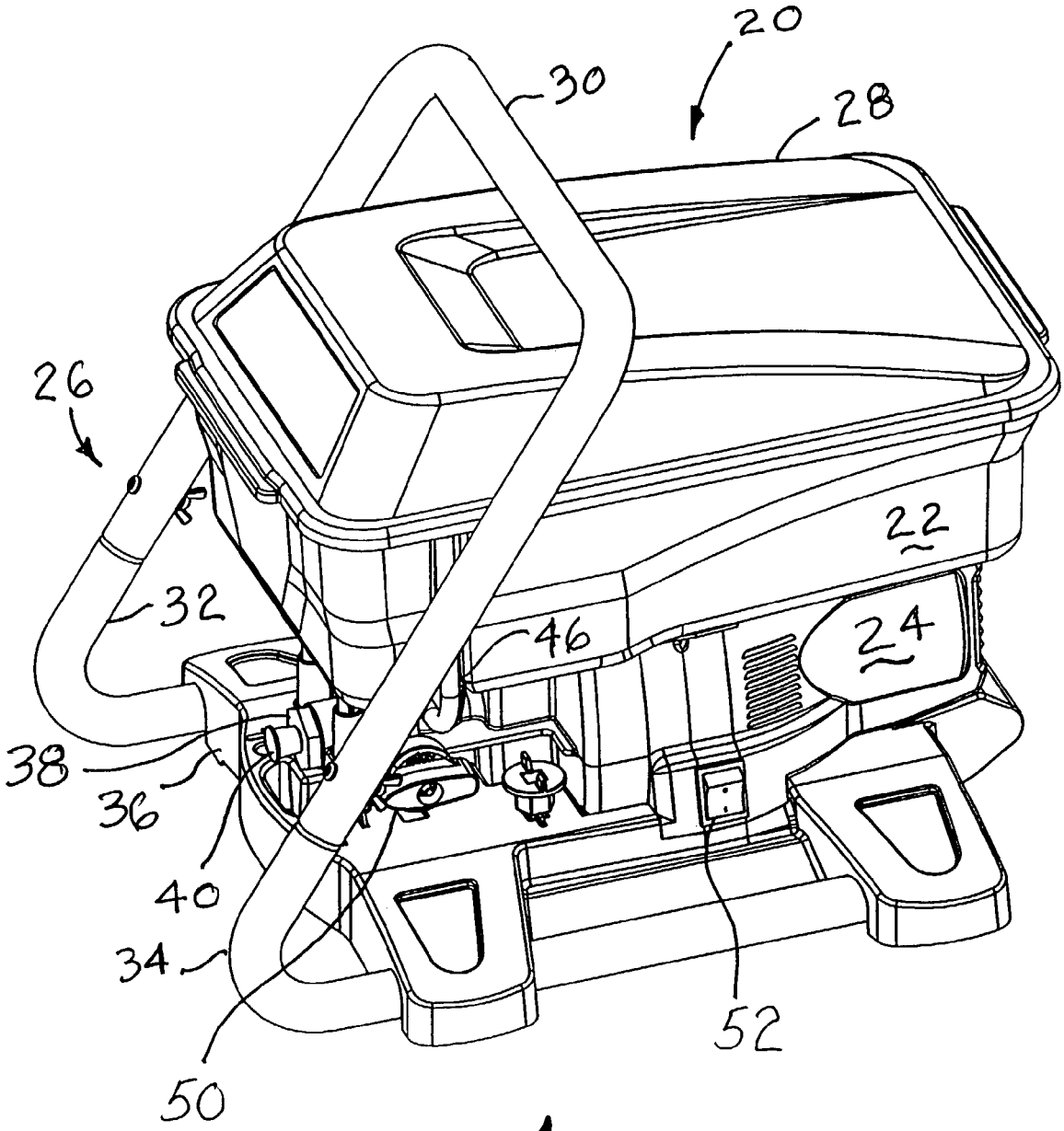
FIG. 1 is a perspective view of a paint pump apparatus useful in the practice of the present invention.
Figure 2:
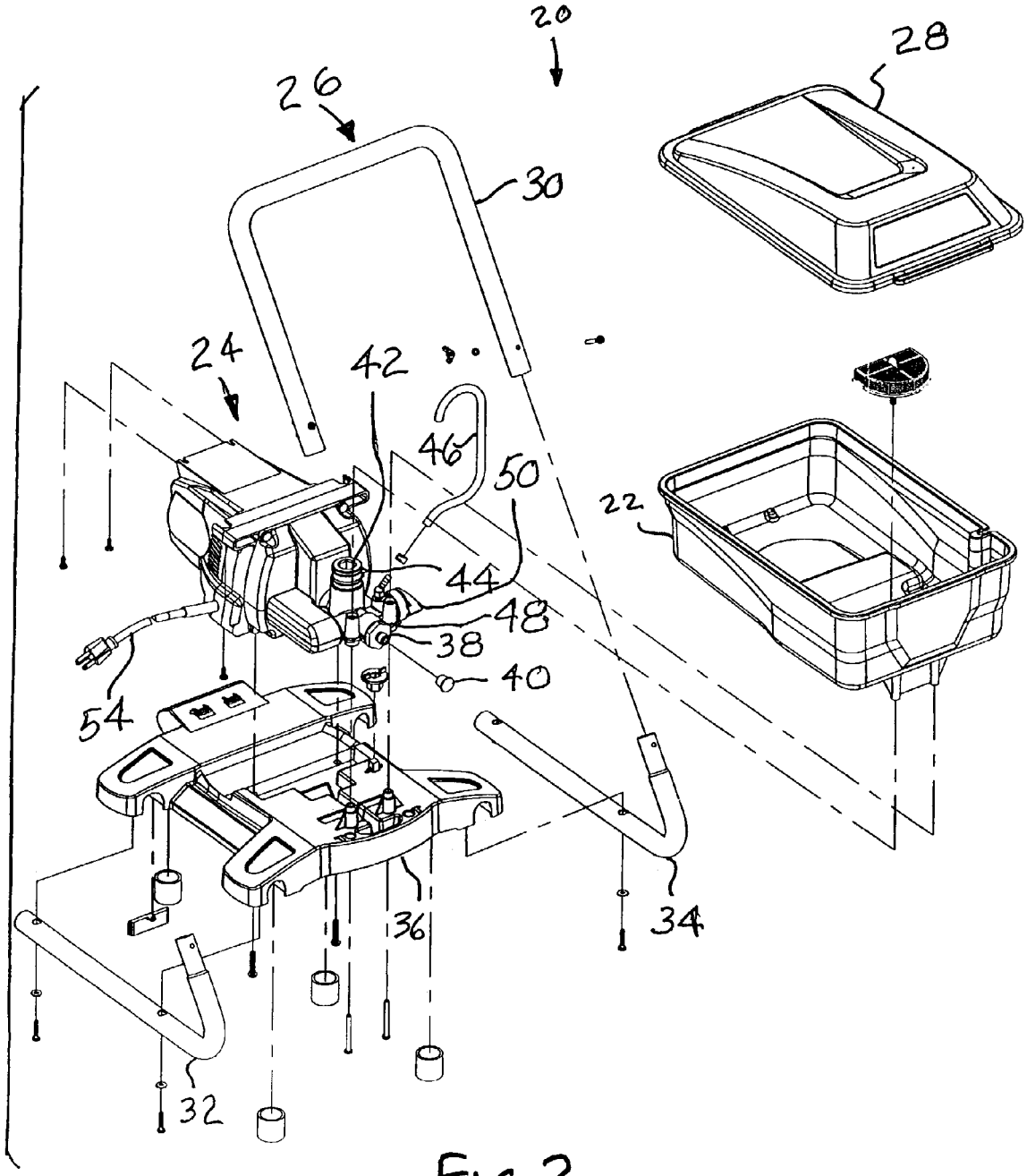
FIG. 2 is an exploded view of the apparatus of FIG. 1.

Referring to the Figures, and most particularly to FIGS. 1–4, a paint pump apparatus 20 useful in the practice of the present invention may be seen. Apparatus 20 is intended to pump paint and similar coatings at high pressure to a spray gun (not shown) for application to a surface to be coated via airless spraying. As will be described infra, the apparatus 20 utilizes a swashplate action to drive a piston in a reciprocating manner without relying on return springs or paint back pressure on the piston to maintain contact between the piston and swashplate on the return stroke.

Apparatus 20 includes a paint reservoir 22 and a pump assembly 24 carried by a frame 26. Reservoir 22 may have a cover 28. Frame 26 preferably has a handle portion 30 and a pair of foot portions 32, 34. Foot portions 32 and 34 are received in a base 36 which supports pump assembly 24. It is to be understood that a high pressure hose (not shown) is connected to an outlet 38 of the pump assembly 24 after a cap 40 is removed. The high pressure hose is also connected to an airless spray gun (not shown) for delivering paint or other coating material to a surface (not shown) desired to be coated. An inlet 42 of the pump assembly 24 is in fluid communication with reservoir 22, and sealed against leakage therebetween by one or more O-rings 44. As may be seen most clearly in FIG. 4, paint is delivered by gravity from reservoir 22 to inlet 42 of the paint pump assembly 24. As is conventional, a return tube 46 is provided from a pump and valve housing 48 containing inlet 42 and outlet 38. Return tube 46 will return paint from the pump to the reservoir during a "priming" mode. A mechanical switch 50 enables transfer from the "priming" mode to a "run" mode wherein paint is delivered to the outlet 38 instead of the return tube 46. An ON-OFF electrical switch 52 enables power from a power cord 54 (when connected to electrical supply, not shown) to be delivered to an electric motor 56. Motor 56 (or another form of prime mover, such as a gasoline engine, not shown) provides mechanical power for pump assembly 24.

Figure 3:
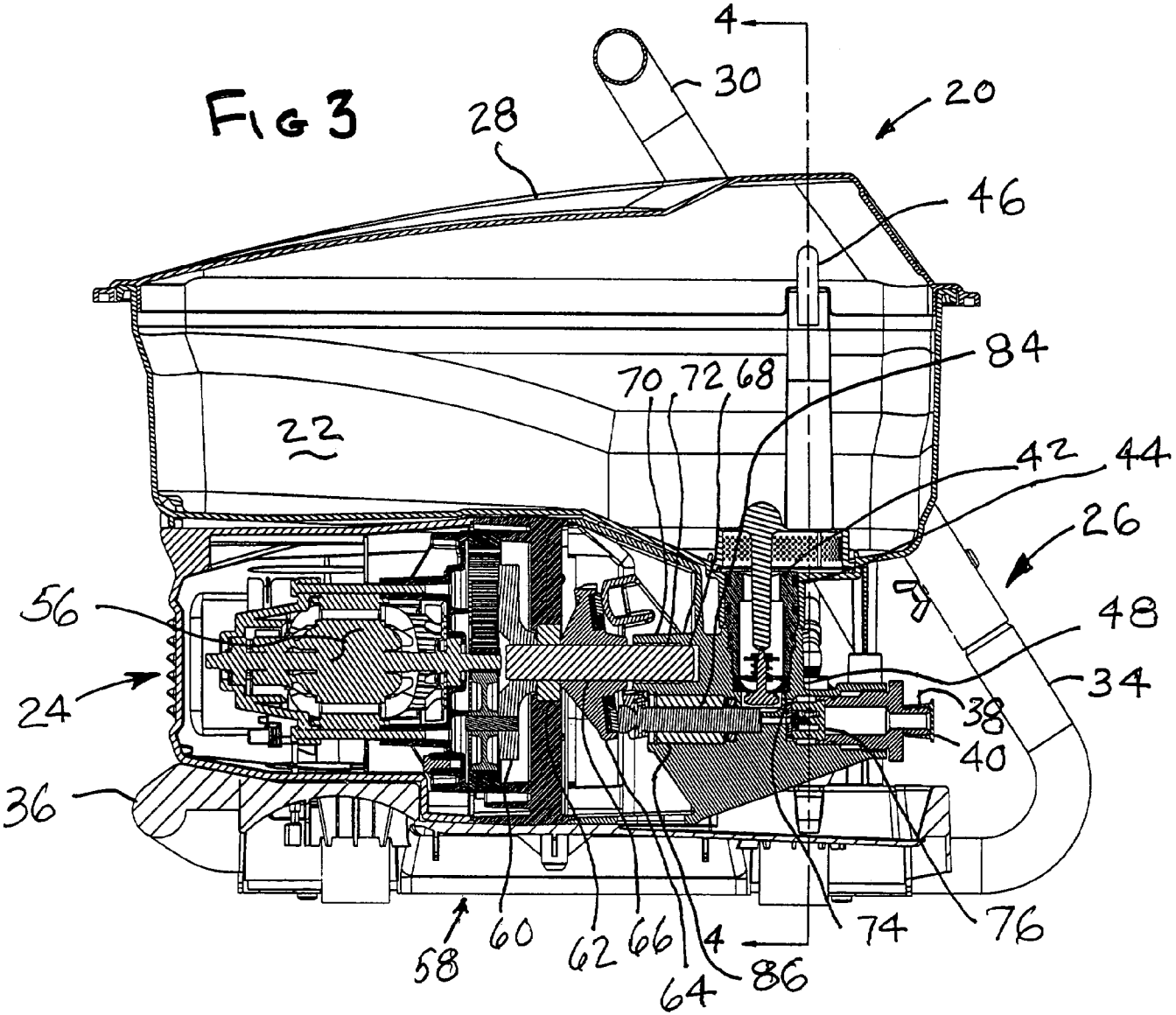
FIG. 3 is a side section elevation view of the apparatus of FIG. 1, taken along line 3—3 of FIG. 4.
Figure 4:
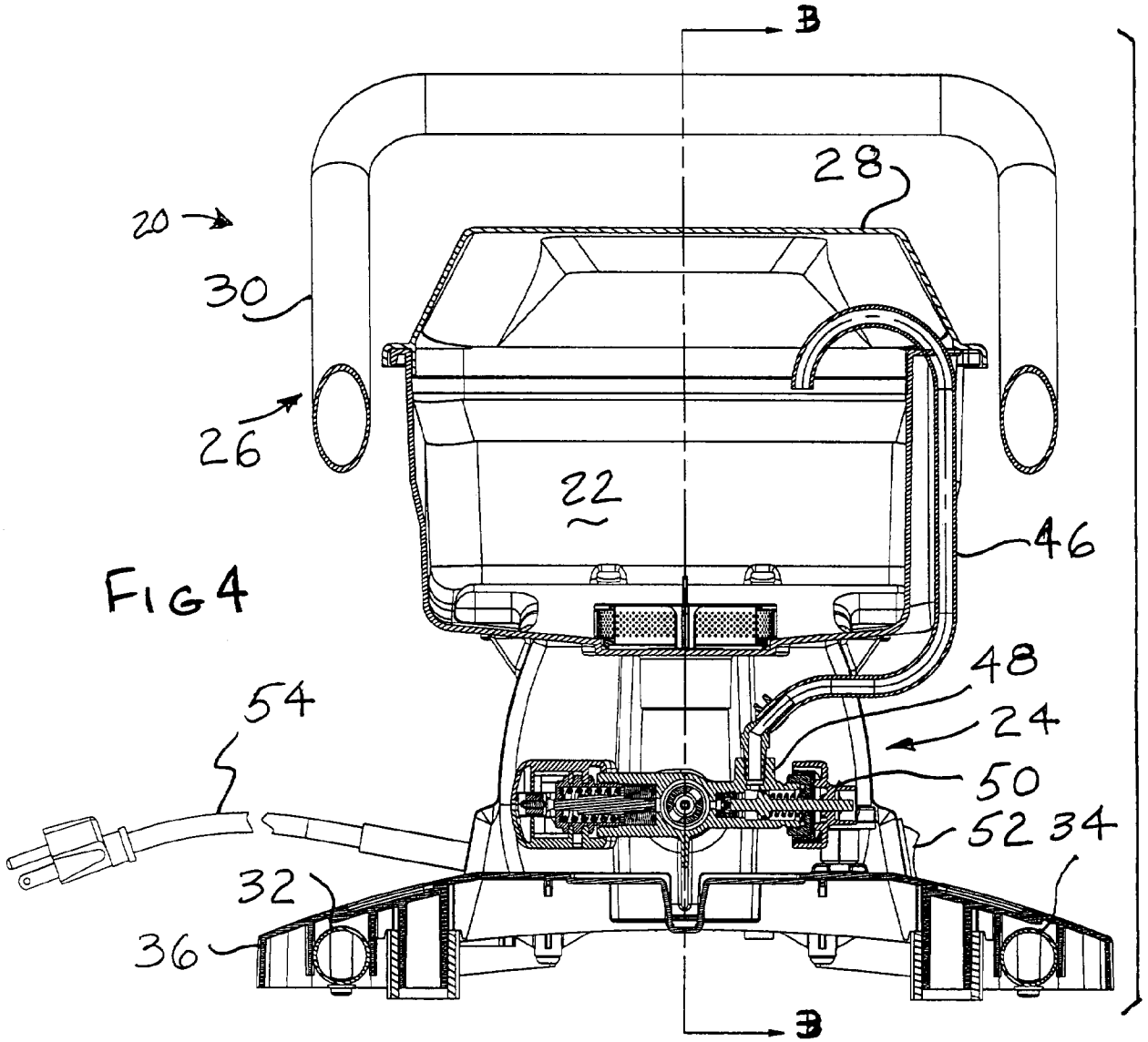
FIG. 4 is an end section elevation view of the apparatus of FIG. 1, taken along line 4—4 of FIG. 3.
Figure 5:
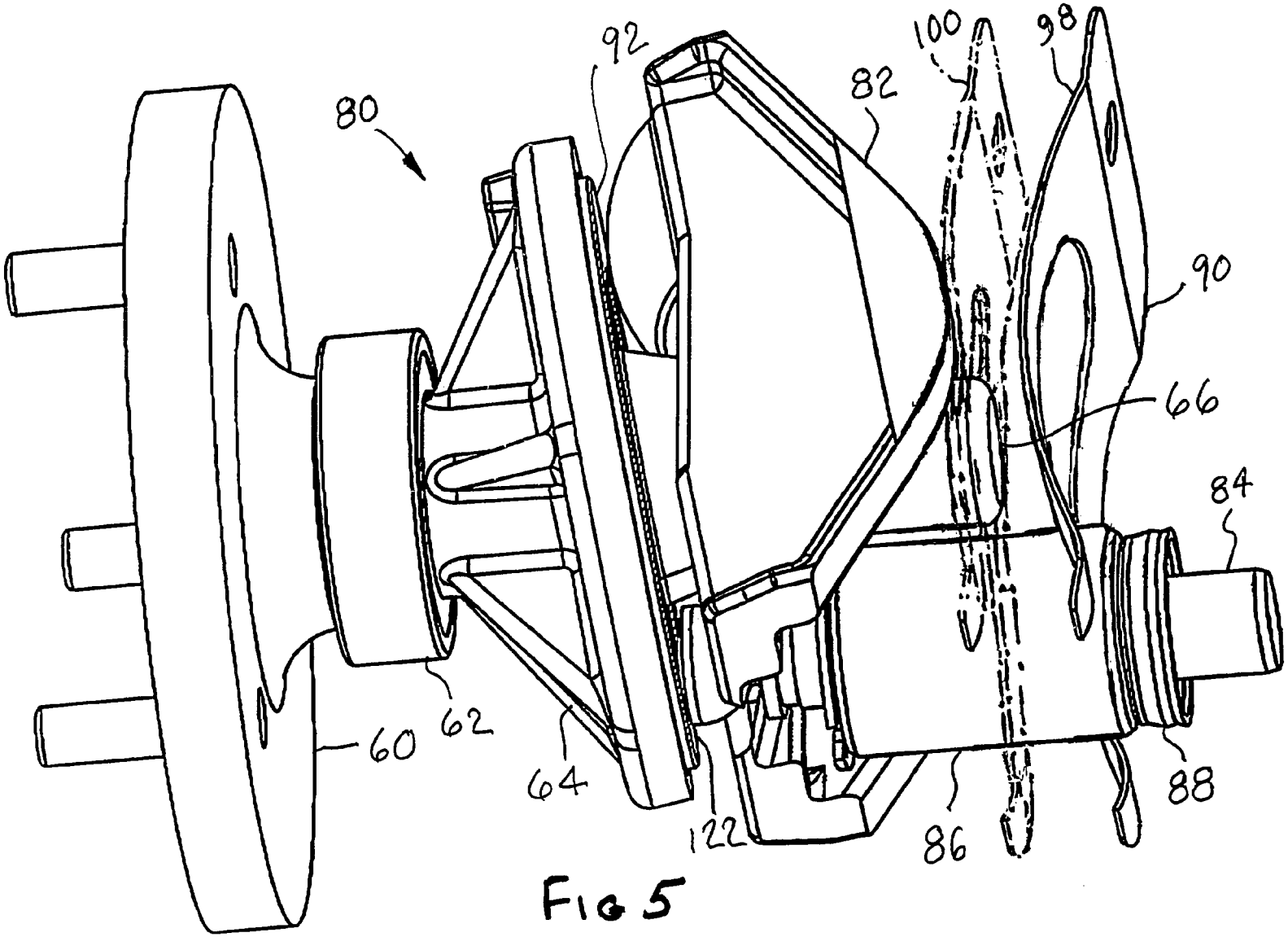
FIG. 5 is a free-body side elevation view of a swashplate assembly from FIG. 3 to illustrate certain aspects of the present invention.
Figure 6:
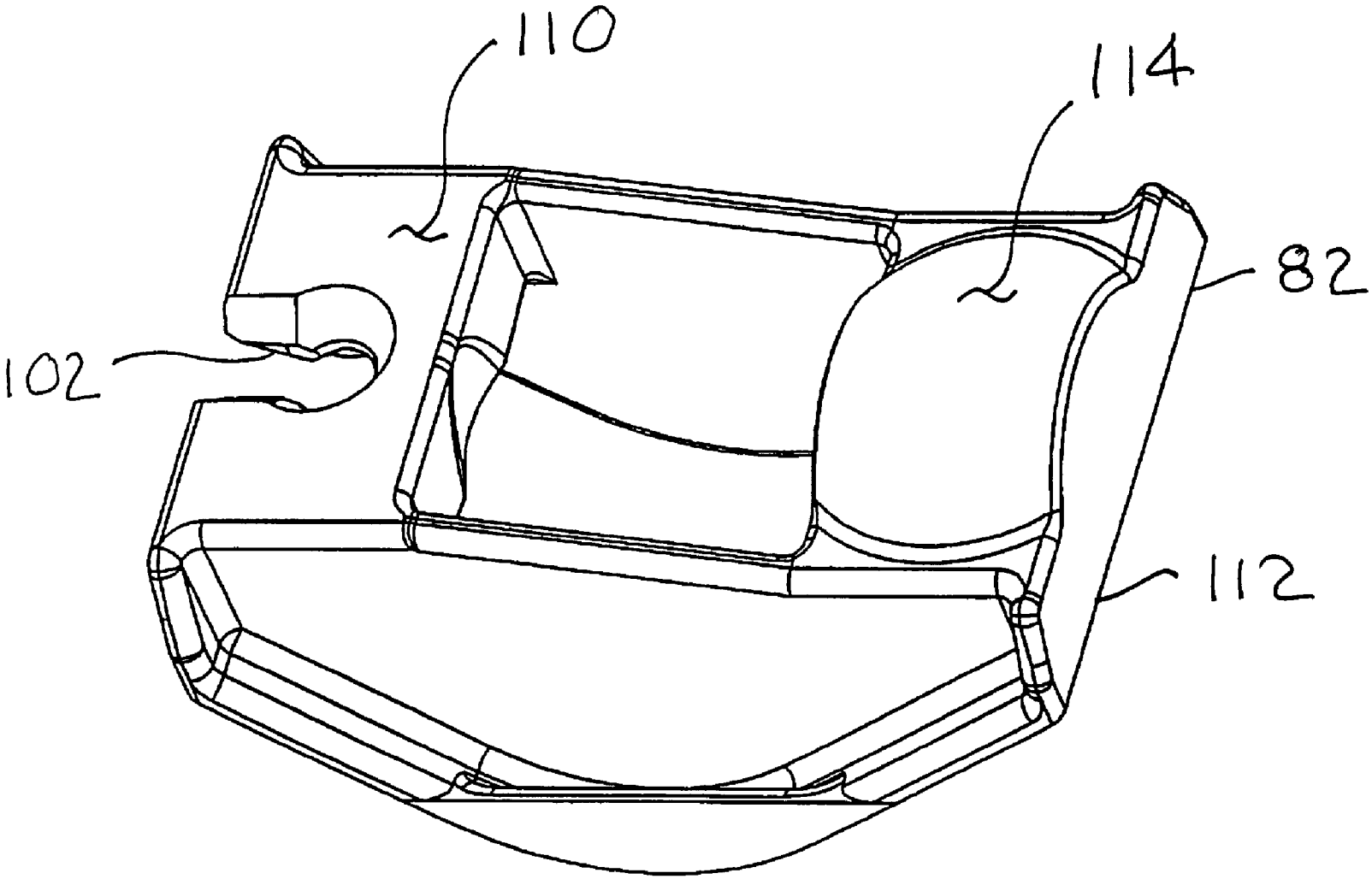
FIG. 6 is a perspective view of a rocker arm useful in the practice of the present invention.
Figure 7:
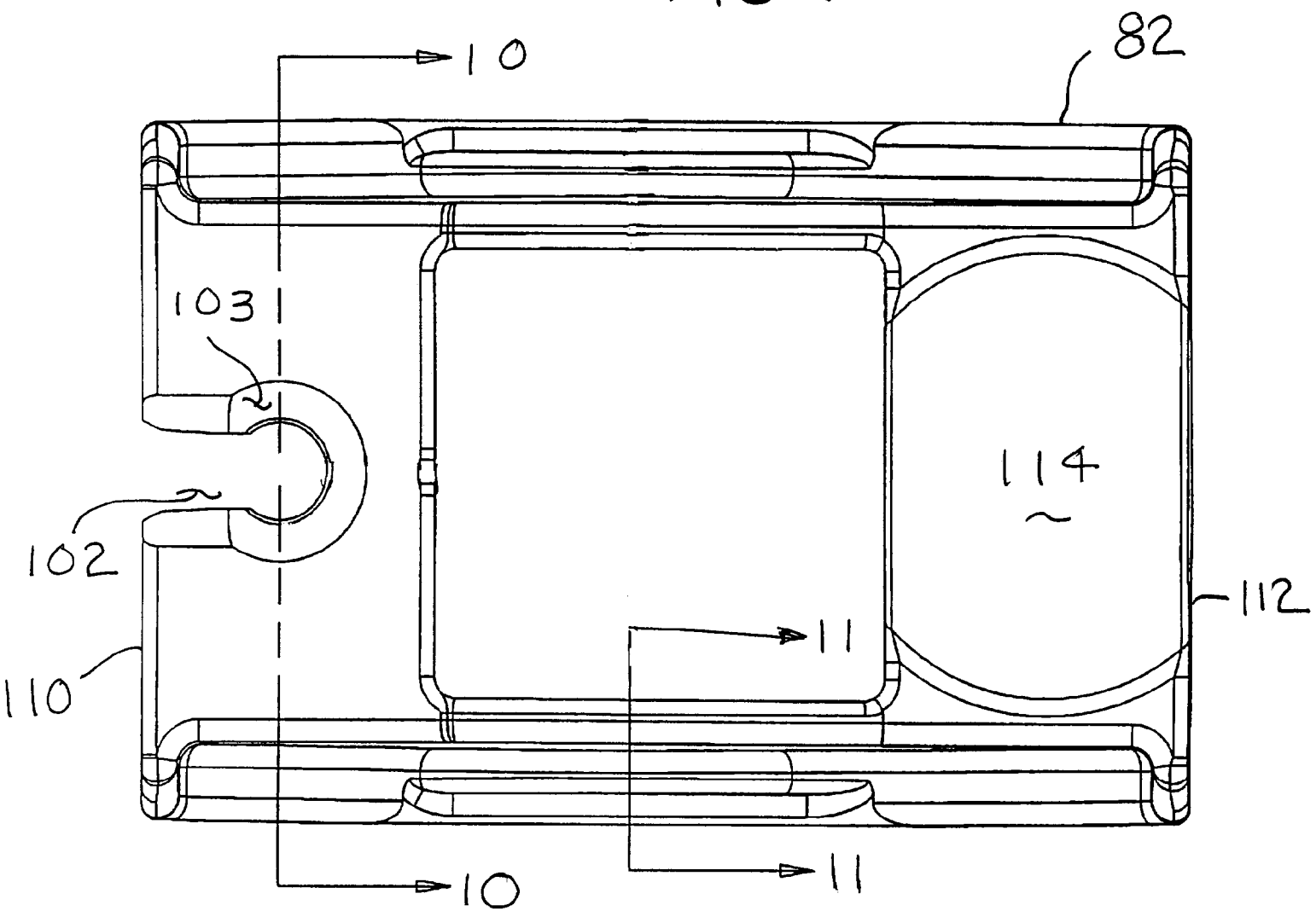
FIG. 7 is a top plan view of the rocker arm of FIG. 6.
Figure 8:
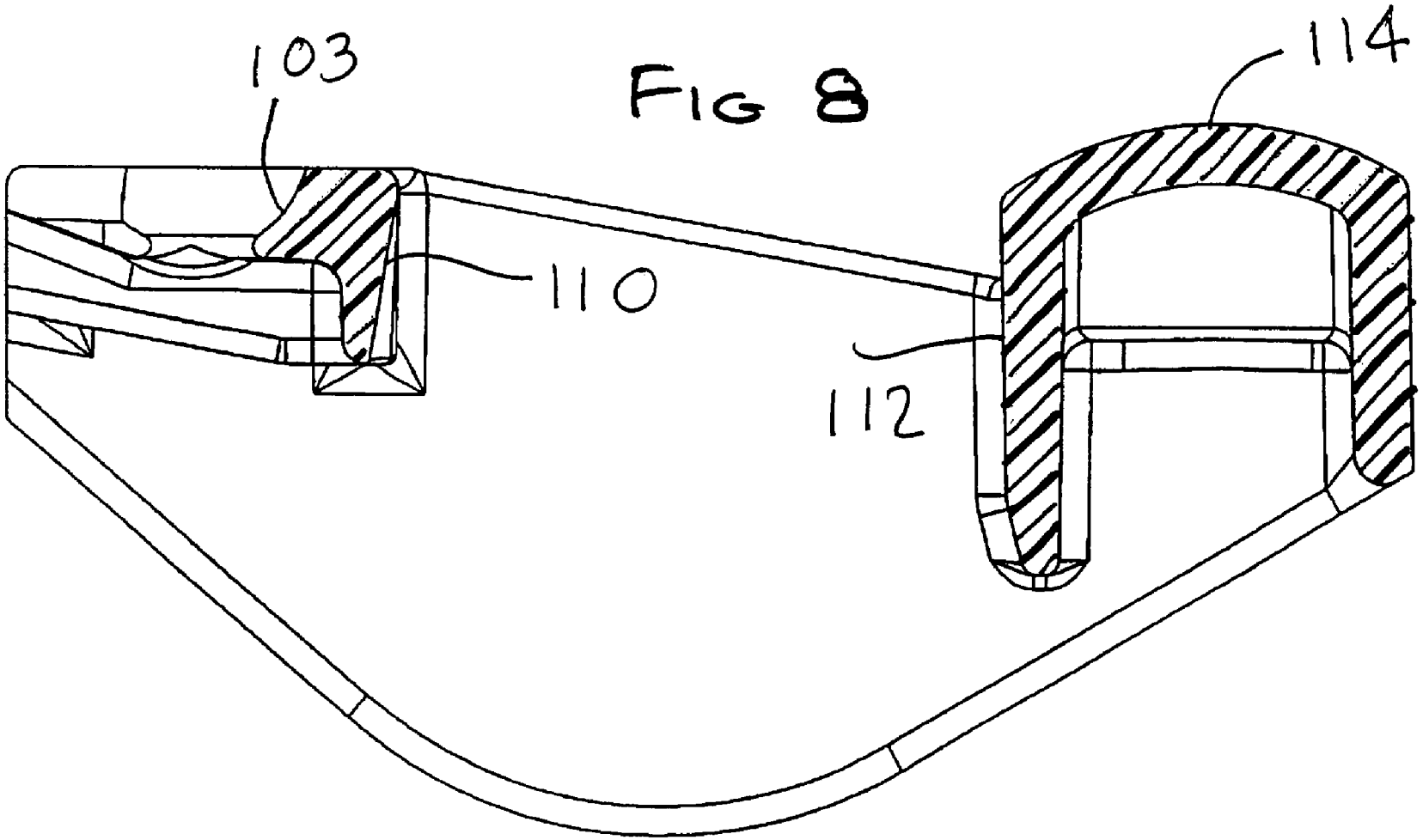
FIG. 8 is a side section elevation view of the rocker arm of FIG. 6, taken along line 8—8 of FIG. 10.
Figure 9:
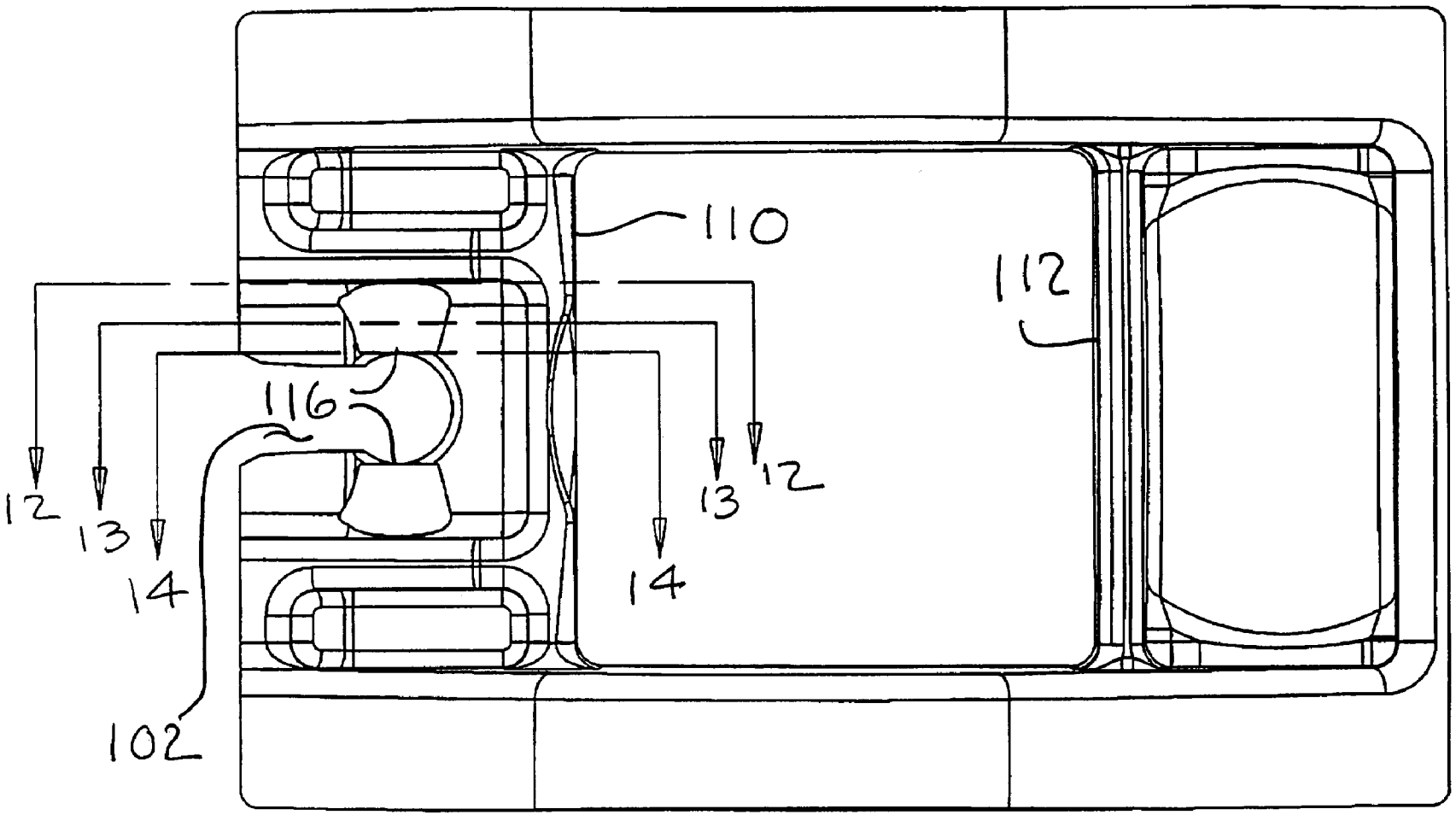
FIG. 9 is a bottom plan view of the rocker arm of FIG. 6.
Figure 10:
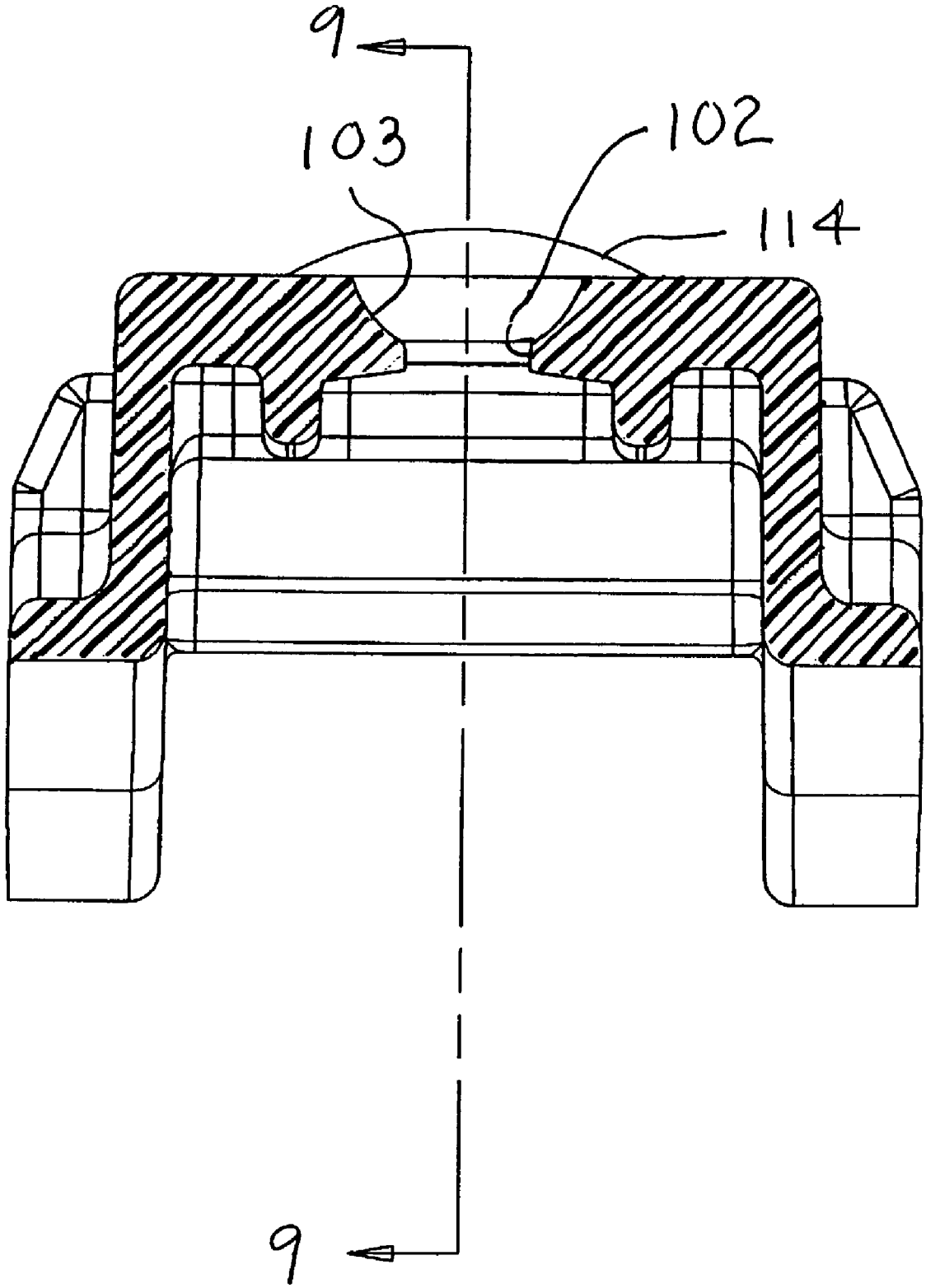
FIG. 10 is an end section elevation view of the rocker arm of FIG. 6, taken along line 10—10 of FIG. 7.
Figure 11:
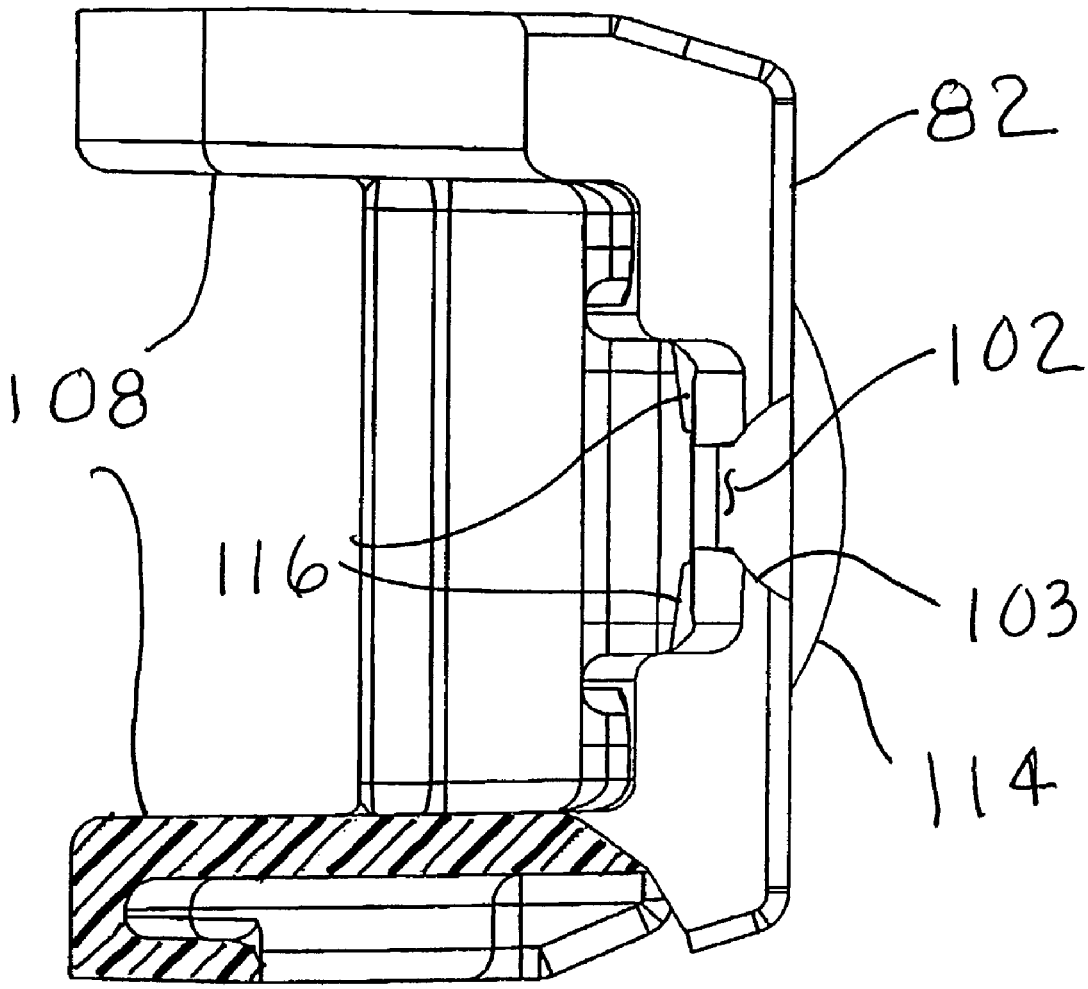
FIG. 11 is an end elevation view of the rocker arm of FIG. 6, with a fragmentary section view taken along line 11—11 of FIG. 7.
Figure 12:
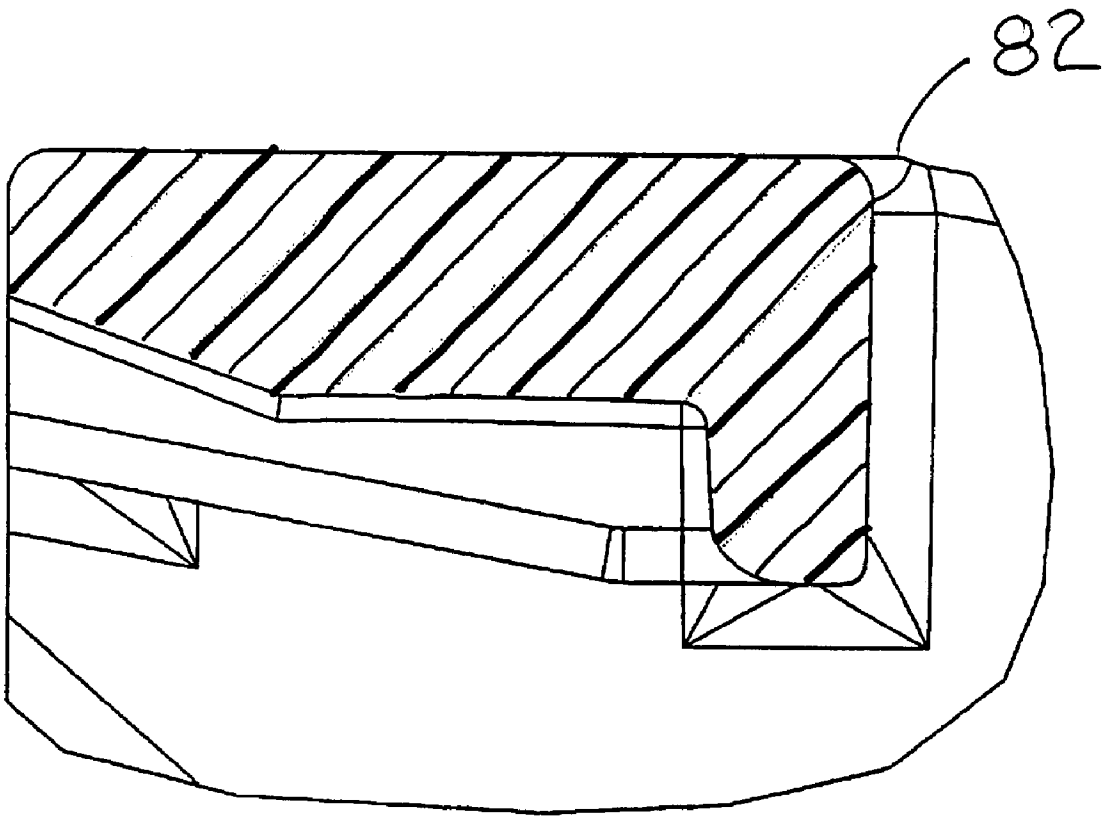
FIG. 12 is a fragmentary section view of a socket of the rocker arm of FIG. 6, taken along line 12—12 of FIG. 10.
Figure 13:
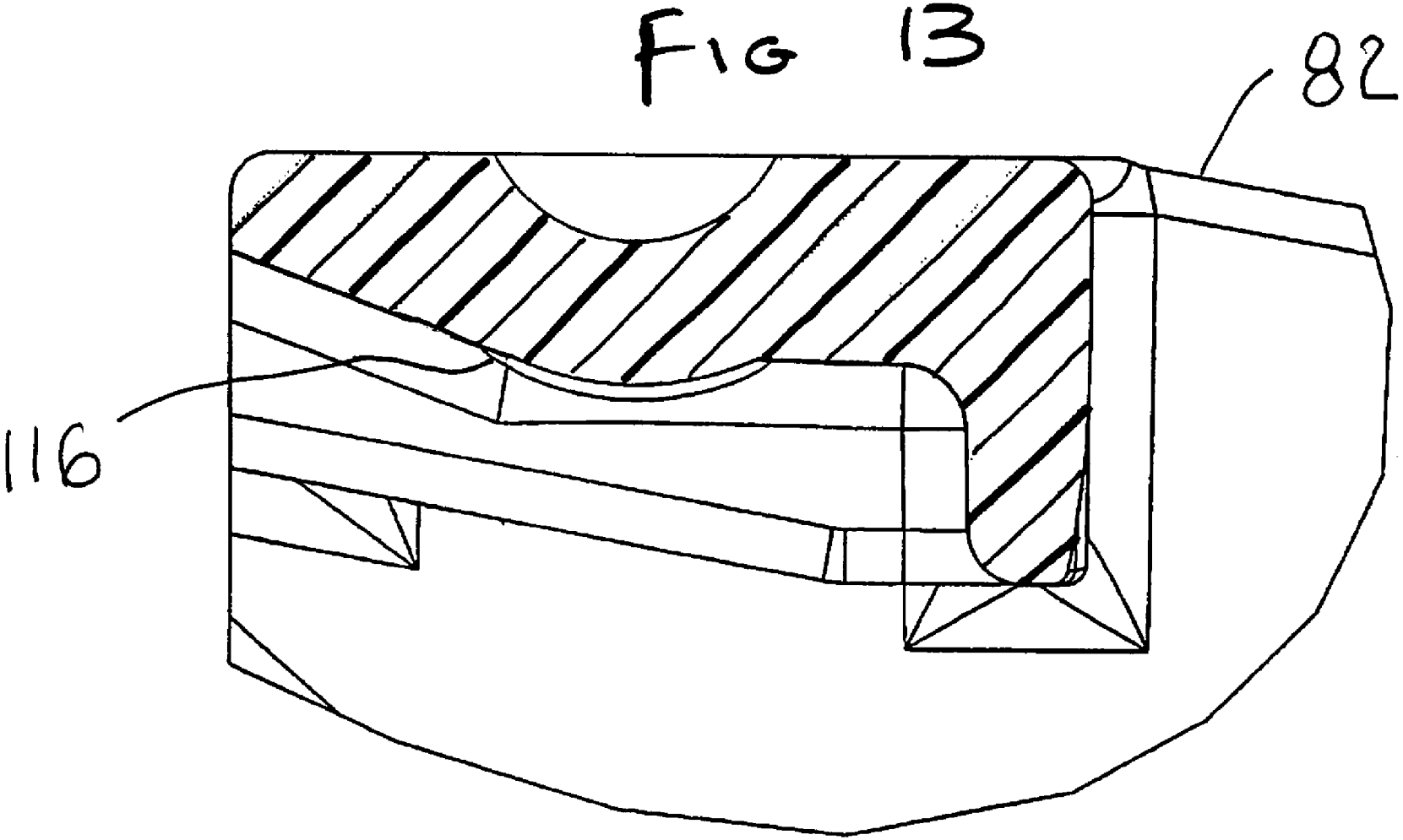
FIG. 13 is a fragmentary section view of a socket of the rocker arm of FIG. 6, taken along line 13—13 of FIG. 10.
Figure 14:
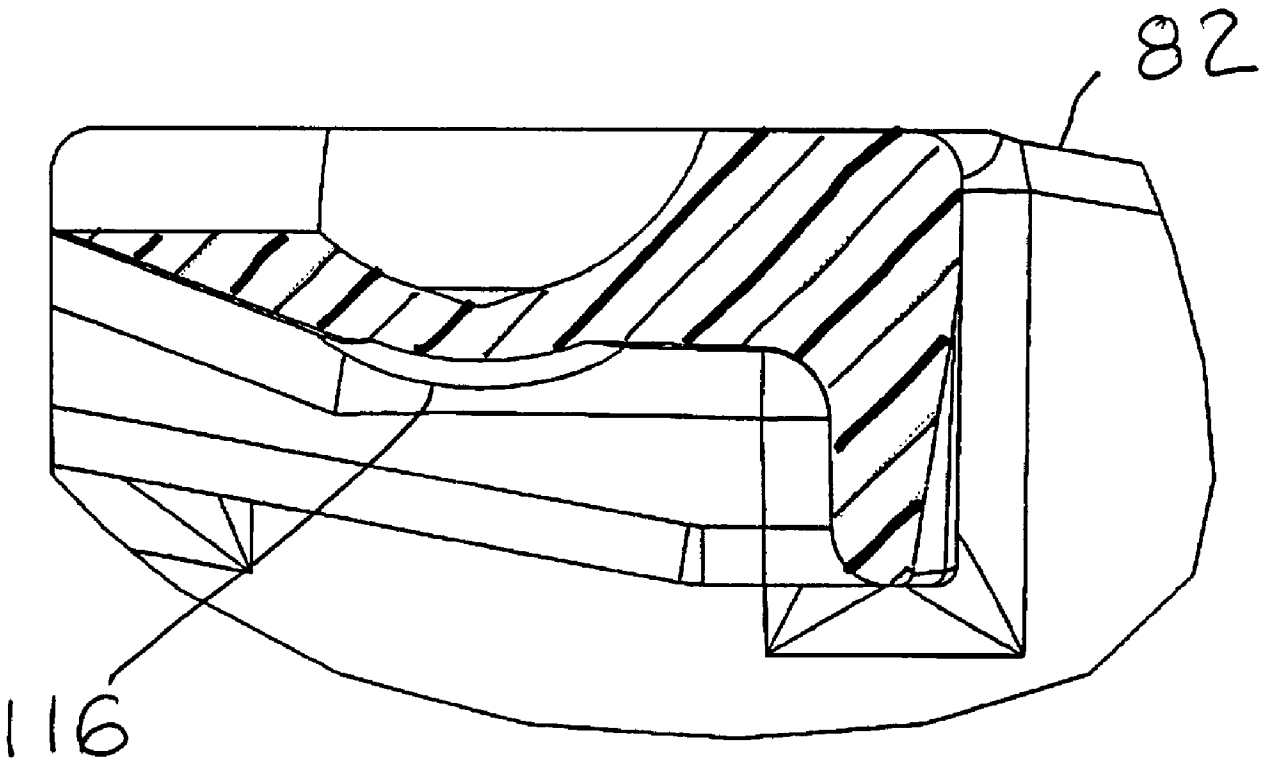
FIG. 14 is a fragmentary section view of a socket of the rocker arm of FIG. 6, taken along line 14—14 of FIG. 10.
Figure 17:
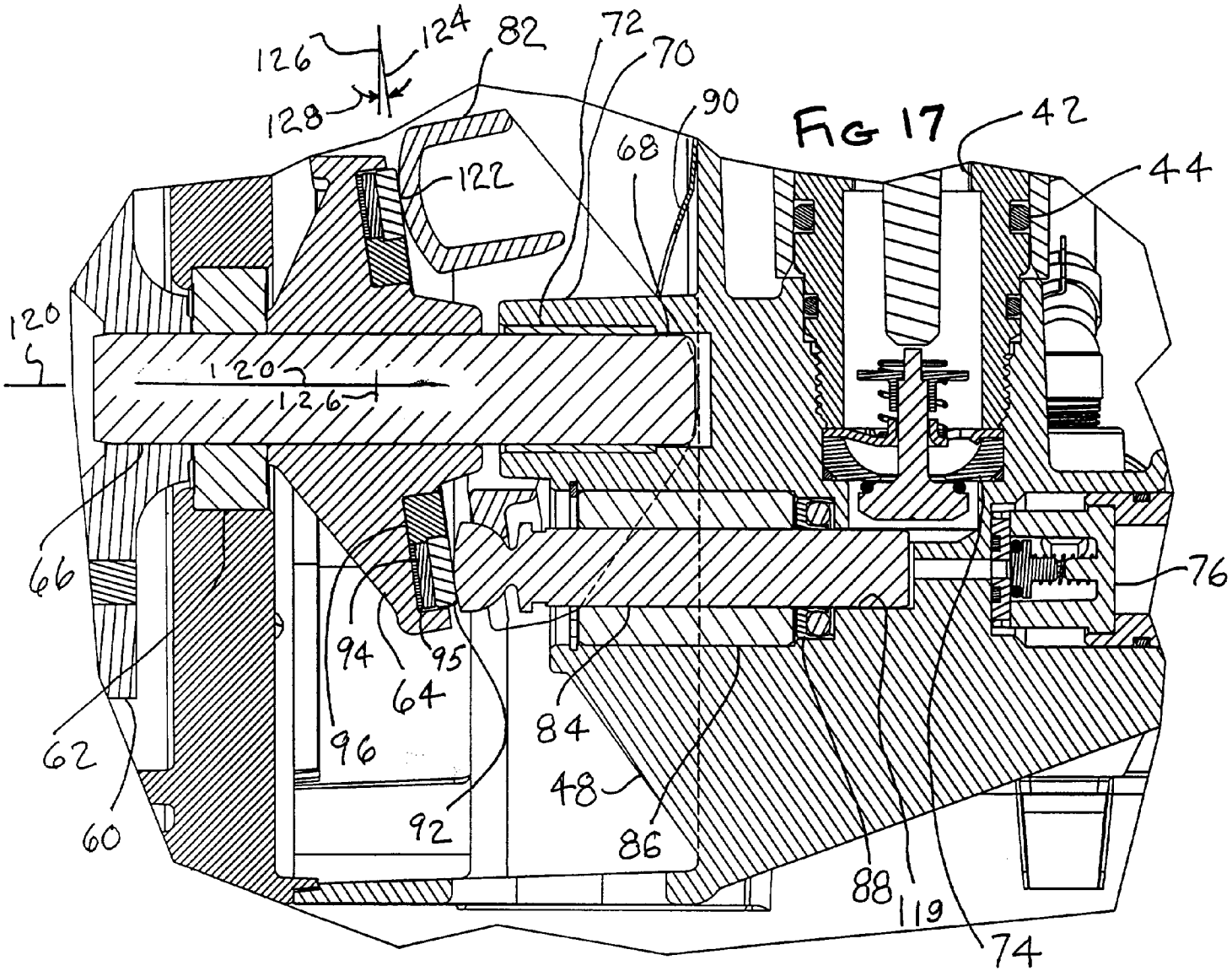
FIG. 17 is a fragmentary section elevation view of a portion of FIG. 3, showing parts of the swashplate assembly with the piston at a bottom dead center position.
Figure 18:
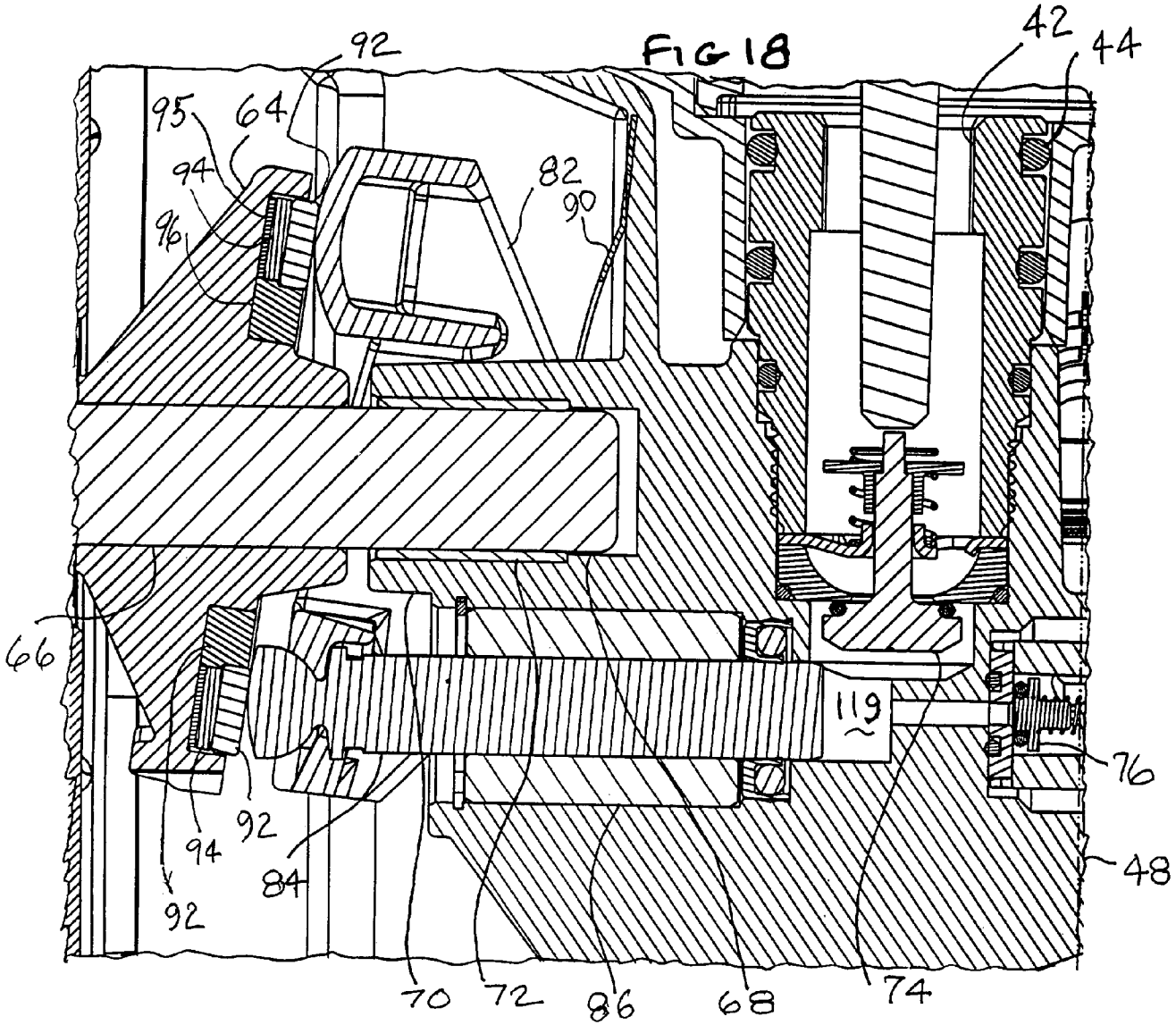
FIG. 18 is a fragmentary section elevation view of a portion of FIG. 3, showing parts of the swashplate assembly with the piston at a top dead center position.

Referring now most particularly to FIGS. 3 and 5, a gear box 58 couples motor 56 to a spider 60 which is journalled for rotation in pump assembly 24 by a bearing 62 and provides direct drive to a swashplate 64 via a shaft 66 on which the spider 60 and swashplate 64 are rigidly mounted. Referring now also to FIGS. 17 and 18, a distal end 68 of shaft 66 is journalled for rotation in a pump assembly housing 70 by a bushing 72.

Referring again to FIGS. 3, 17 and 18, an inlet check valve 74 is positioned in inlet 42. Similarly an outlet check valve 76 is positioned in outlet 38.

Figure 19:
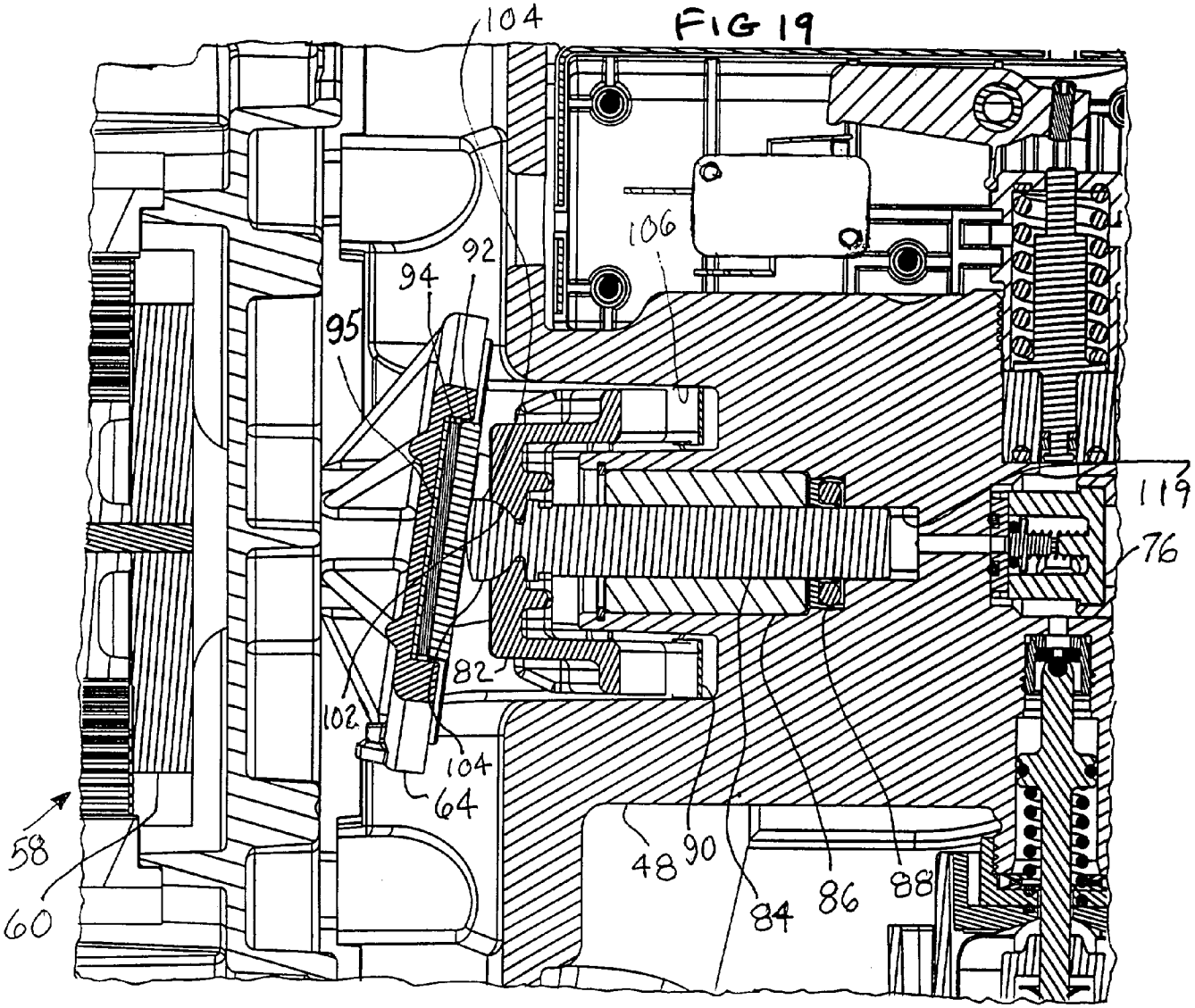
FIG. 19 is a fragmentary section bottom plan view of a portion of FIG. 3, showing parts of the swashplate assembly with the piston at a mid stroke position.

FIG. 5 illustrates a swashplate assembly 80, which includes the spider 60, bearing 62 and swashplate 64 all mounted on shaft 66. Assembly 80 also includes a rocker arm 82, a piston 84, a sleeve bearing or bushing 86, a seal 88, and a spring 90. Additionally, assembly 80 includes an annular thrust plate 92, thrust bearing 94 and an annular radial spacer 96 as part of the swashplate 64, as may be seen most clearly in FIGS. 17, 18 and 19. Returning to FIG. 5, spring 90 is shown in solid lines 98 to illustrate the spring itself in a relaxed state and spaced apart from its operating position, and is shown in chain lines 100 in its operating position, where it is urging the rocker arm 82 towards the swashplate 64. Spring 90 preferably applies at least a 10 pound force on rocker arm 82 in the embodiment shown. Rocker arm 82 has a keyhole shaped recess 102 which is engaged with a generally spherical head 104 of piston 84, as may be most clearly seen in FIGS. 15 and 16. In operation, swashplate 64 is rotated by motor 56 acting through gear box 58 and spider 60 when pump assembly 24 is to be operated, since swashplate 64 is carried on shaft 66. Rocker arm is constrained in a congruent cavity 106 (see FIG. 19) in pump and valve housing 48, but is free to oscillate in a rocking motion when driven by rotation of swashplate 64. The piston 84 follows the motion of keyhole recess 102, reciprocating in a substantially linear motion, since it is constrained by sleeve bearing 86 against side motion caused by side loads imposed on the head 104 of piston 84 as the swashplate 64 tilts with respect to the piston 84 during operation. Reciprocation of piston 84 will draw paint into a pumping chamber 119 through inlet 42 and deliver paint under pressure via outlet 83.

Referring now to FIGS. 6–14, various details of the rocker arm 82 may be seen. Arm 82 is preferably molded of an acetal resin polymer such as is offered under the trademark Delrin by DuPont. Arm 82 has a pair of arched support legs 108 spanned by a first bridge 110 containing the key hole shaped recess 102, and further spanned by a second bridge 112 having a dome 114 therein. Dome 114 preferably has a spherical radius of 0.75 inches and the recess 102 preferably has a spherical recess 103 with a radius of 0.25 inches in the embodiment shown. A pair of slightly raised shoulders or ramps 116 are located on the underside of bridge 110, adjacent lateral sides of the key hole shaped recess 102 to limit the amount to which the piston 84 can pivot laterally up to an angle 118 (shown in FIG. 16) of ±2 degrees. Details of shoulders 116 may be seen in FIGS. 9, 13 and 14. It is to be understood that the piston 84 is retained to the rocker arm 82 in a "snap fit" or detent arrangement wherein the socket end 110 of the rocker arm will temporarily deform to receive the piston, and thereafter retain the piston, while allowing a limited range of angular motion between the piston 84 and the rocker arm 82. The range of angular motion permitted is sufficient to permit piston 84 to remain aligned with the sleeve bearing 86 as the rocker arm 82 pivots to follow the motion of swashplate 64. Bearing 86 maintains piston 84 in substantially constant cylindrical alignment with the cylinder chamber 119 in housing 48 as piston 84 reciprocates to provide the pumping action from pump assembly 24. It is to be understood, however that piston 84 preferably has a slight radial degree of freedom with respect to bearing 86, preferably between about 0.0025 inches and 0.0005 inches, which has been found to improve the life of seal 88. This is achieved in the embodiment shown and described by having a bore in the sleeve bearing 86 with a diameter of 0.439 +0.000 −0.001 inches with the piston diameter described infra.

Figure 15:
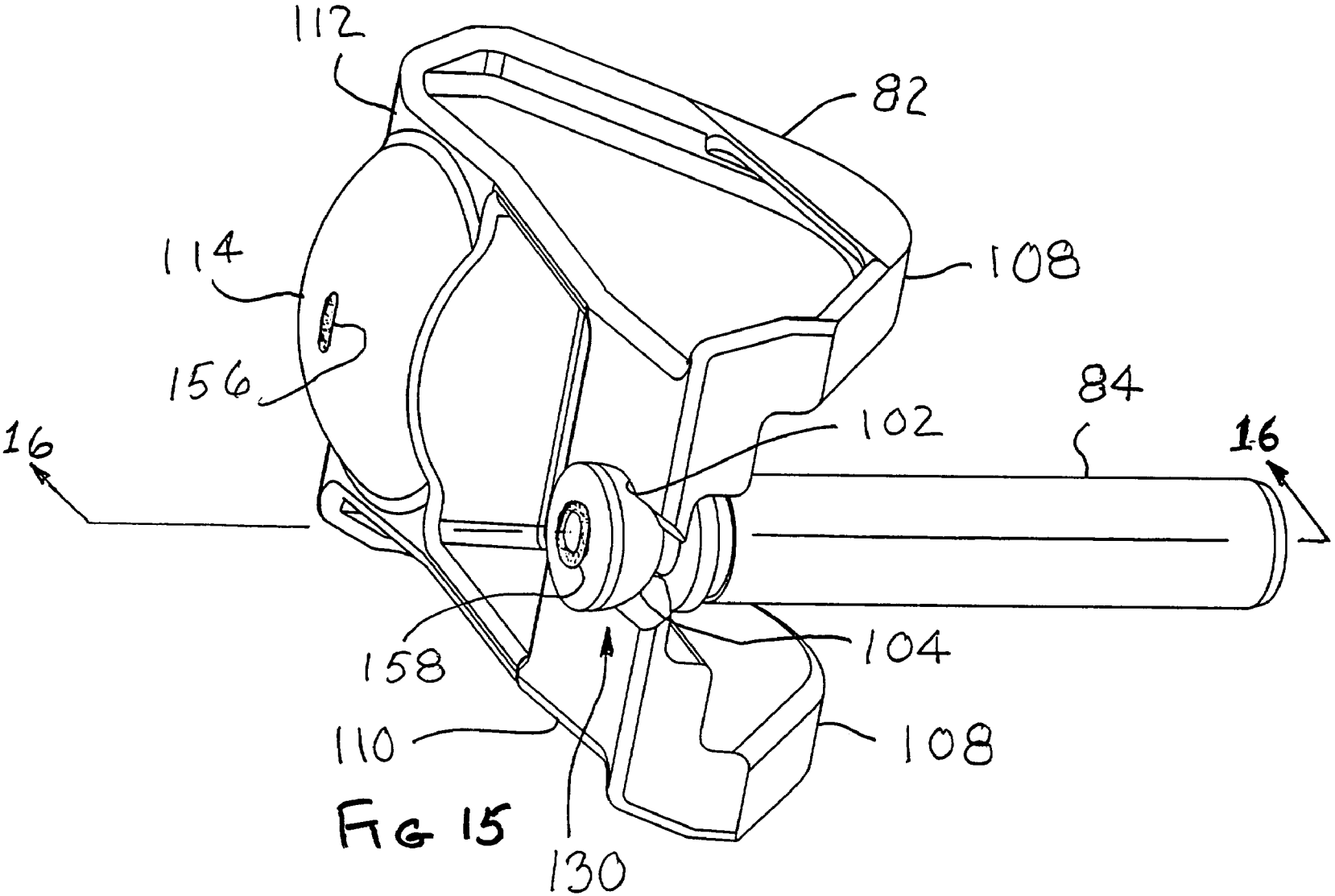
FIG. 15 is a perspective view of the rocker arm of FIG. 6, assembled together with a piston and useful in the practice of the present invention.
Figure 16:
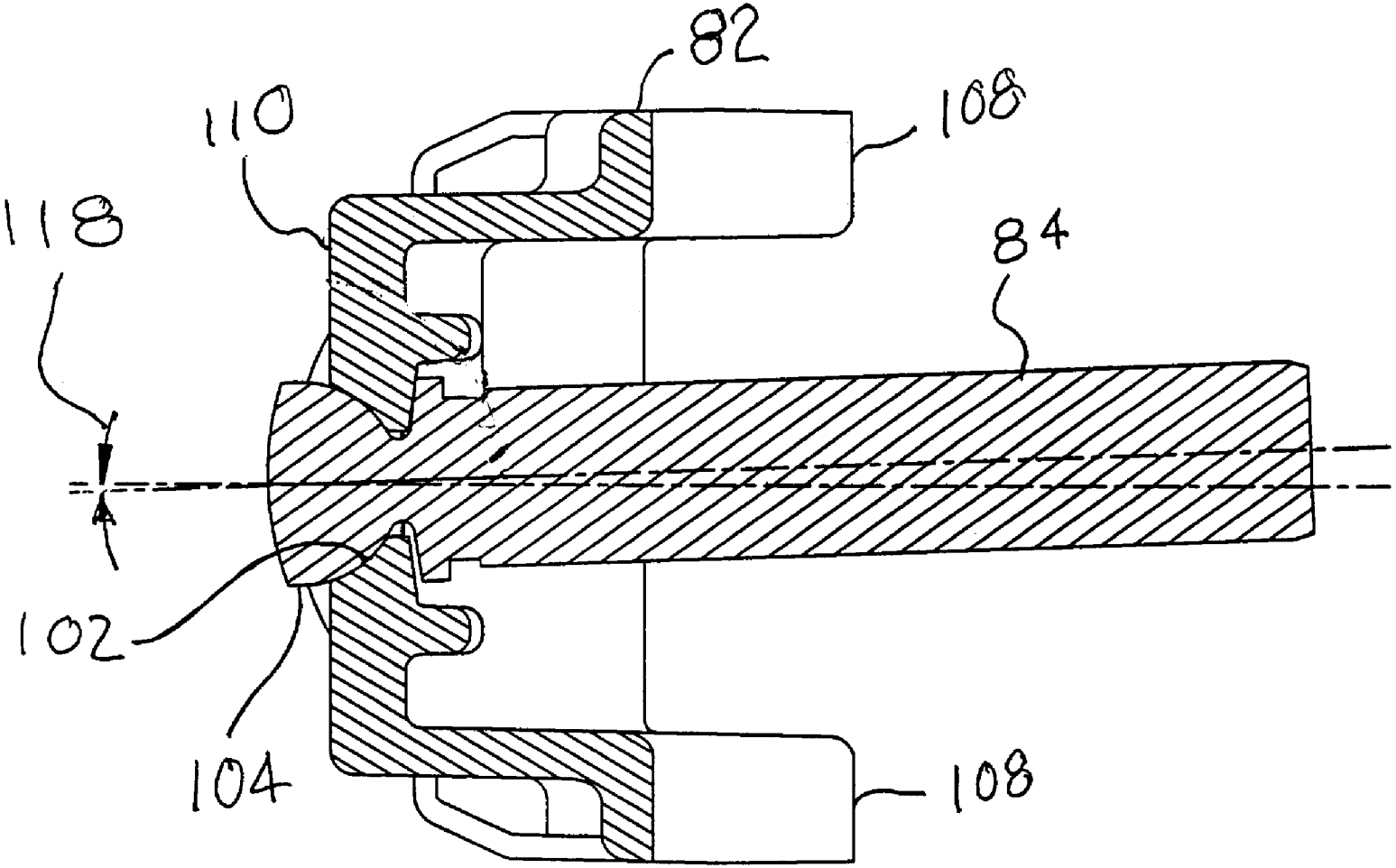
FIG. 16 is an end section view of the rocker arm and piston, taken along line 16—16 of FIG. 15.

Referring now most particularly to FIG. 15, dome 114 exhibits a characteristic elongated footprint 156, corresponding to a wear pattern resulting from contact between dome 114 and plate 92 of swashplate assembly 80.

Referring to FIG. 17, swashplate 64 has an axis of rotation 120. A plane of a drive surface 122 of the swashplate 64 is indicated by line 124. Line 126 represents a plane which is perpendicular to the axis of rotation 120. The drive surface 122 of swashplate 64 is preferably predetermined to be a profile angle 128 of 8 degrees, as measured between planes 124 and 126, keeping in mind that FIG. 17 shows swashplate 64 at a bottom dead center position for piston 84.

Figure 21:
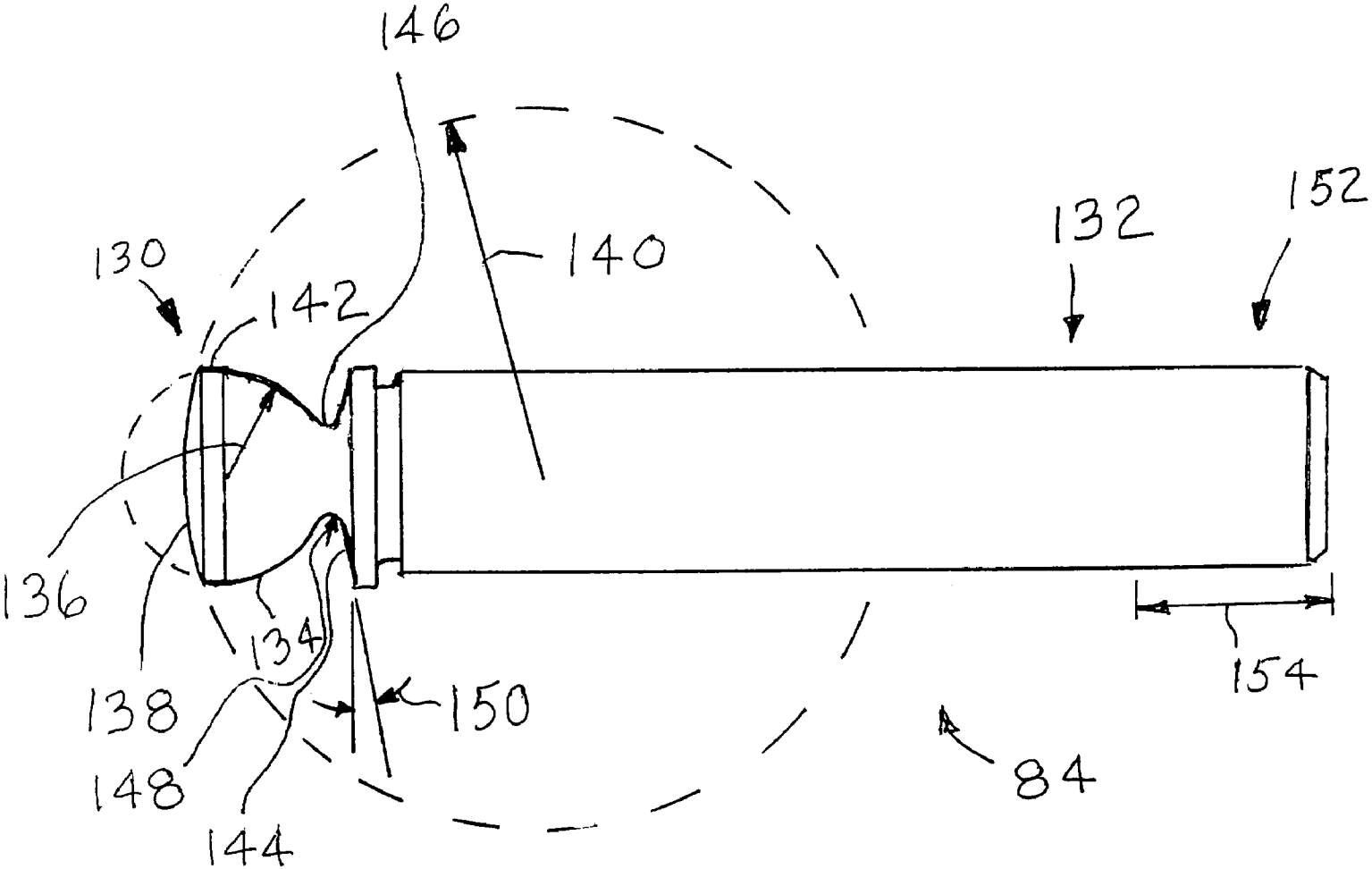
FIG. 21 is a side view to illustrate certain features of a piston useful in the practice of the present invention.

Referring now to FIG. 21, piston 84 is preferably formed of 440 C stainless steel, (preferably heat treated to Rc 56–58) and preferably has a head portion 130 and a main cylindrical body portion 132. A diameter 152 of the main cylindrical portion 154 is preferably 0.437±0.0005 inches. The head portion 130 has a ball-joint-like surface 134 formed with a generally spherical radius profile indicated by radius 136, which, in the embodiment shown, is preferably 0.25 inches. The head portion 130 has a convex end surface 138 with a generally spherical profile preferably having a radius 140 greater than radius 136. In the embodiment shown, radius 140 is preferably 0.75 inches. A cylindrical surface 142 (of preferably 0.5 inches diameter) connects the convex end surface 138 and the ball-joint-like surface 134. The main cylindrical body has a cone shaped surface 144 spaced apart from and facing the ball-joint-like surface 134. Cone shaped surface 144 is connected to the ball-joint-like surface by a concave cylindrical neck portion 146 preferably having a 0.031 inch radius 148 for the embodiment shown. Cone shaped surface 144 preferably has a cone angle 150 substantially equal to the profile angle 128 of the swashplate 64, which in this embodiment is preferably 8 degrees. The piston is preferably machined to a finish of 32 microinches, except for a distal end 152 which is preferably finished to 15 microinches for a distance 154 of 0.62 inches, which includes the "working" portion of the piston 84 in contact with seal 88. Convex end surface 138 exhibits a characteristic circular or toroidal footprint 158, corresponding to a wear pattern resulting from contact between the end surface 138 of head portion 130 of piston 84 and plate 92 of swashplate assembly 80. Footprint 158 results from rotation of piston 84 in the pump assembly 24 during operation.

Figure 20:
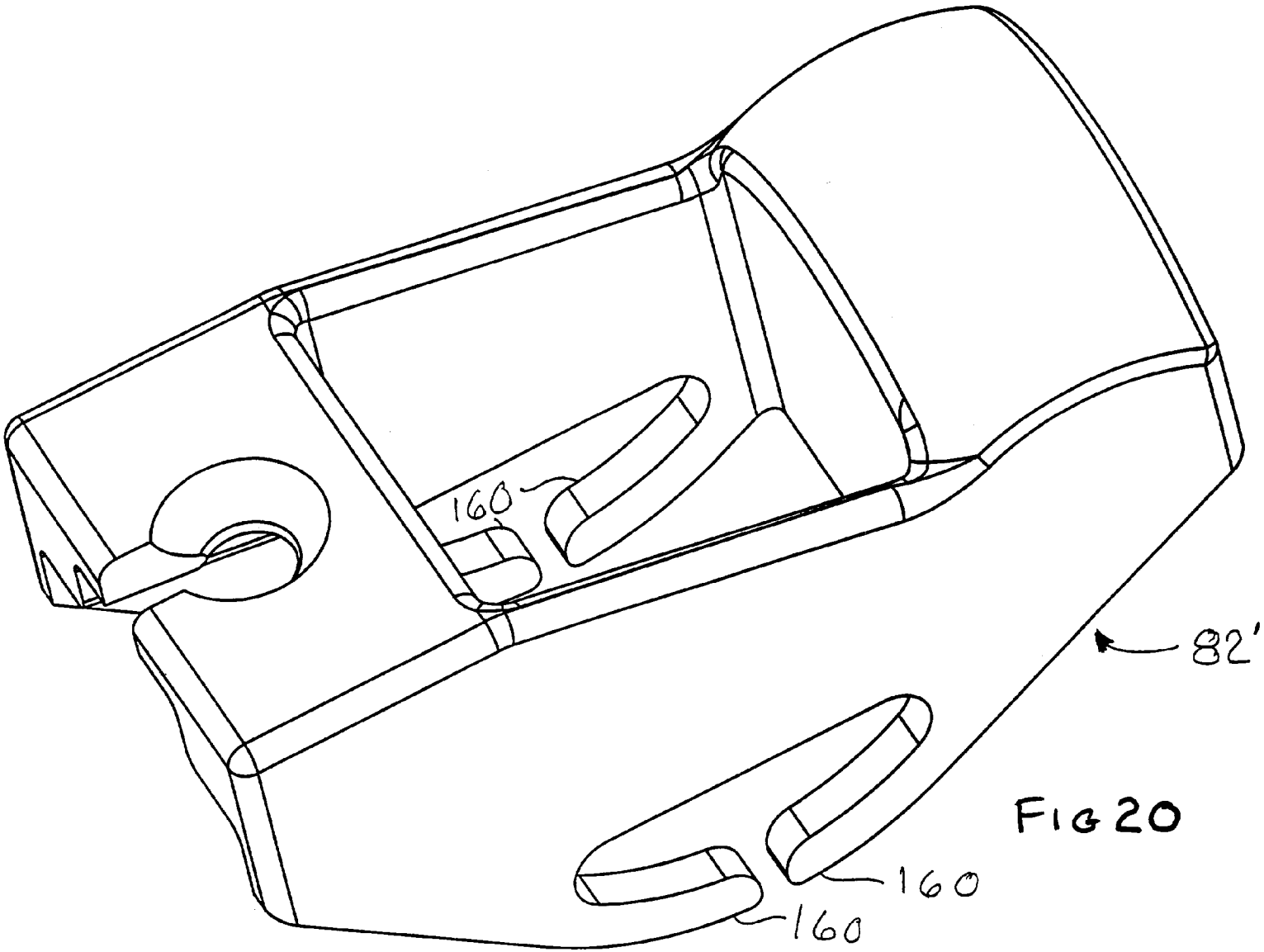
FIG. 20 is an alternative embodiment for the rocker arm useful in the practice of the present invention.

Referring now to FIG. 20, spring 90 may be replaced with one or more integrally formed cantilevered fingers 160, preferably two pair of such fingers, with one pair of fingers located on each of opposite lateral sides of the rocker arm 82'.

In operation, it is to be understood that the piston pump assembly 24 operates from a source of rotary power such as electric motor 56 (or an alternative power source, not shown, such as an internal combustion engine). The rotary power source rotatingly drives a swashplate assembly 80 which in turn is in contact with a rocker arm 82. The swashplate reciprocates the rocker arm, causing the piston to pump paint in a reciprocating motion by driving the piston in a first direction and by action of the rocker arm returning the piston in a second direction opposite to the first direction. This eliminates the need for a piston return spring commonly found in prior art swashplate pump designs. In the present invention, the rocker arm and piston contact the swashplate at diametrically opposite regions of the swashplate, more particularly contacting the annular thrust plate 92. The needle bearing 94 is interposed between the thrust plate 92 and a backing plate 95. The piston is guided by the sleeve bearing 86, and cup seal 88 prevents paint from leaking past the piston out of the pumping chamber 119. As the piston moves from the position shown in FIG. 17 to the position shown in FIG. 19, paint is drawn from the reservoir 22 through the inlet check valve 74. As the piston moves from the position shown in FIG. 19 to the position shown in FIG. 17 paint is moved out of the pumping chamber 119 past the outlet check valve 76 to be delivered to a spray gun (not shown).

It is to be understood that the numerical values for radii, angles and other parameters of the embodiment described may be varied from those stated, while still remaining within the scope of the present invention.

The invention is not to be taken as limited to all the details thereof as modifications and variations thereof may be made without departing from the spirit or scope of the invention.

What is claimed is:

1. A piston pump assembly for pumping paint and similar liquid coatings comprising a. a source of rotary power;

b. a swashplate connected for rotation to the source of rotary power;

c. a rocker arm in direct contact with the swashplate and arranged to reciprocate in a rocking motion as the swashplate rotates; and d. one and only one piston in contact with the swashplate and connected to the rocker arm and arranged to reciprocate by action of the swashplate driving the piston in a first direction and by action of the rocker arm returning the piston in a second direction opposite to the first direction.

2. The assembly of claim 1 wherein the rocker arm and piston contact the swashplate at diametrically opposed regions of the swashplate.

3. The assembly of claim 1 wherein the swashplate further comprises a swashplate assembly including a swashplate base and an annular plate contacting both the rocker arm and the piston at diametrically opposed regions.

4. The assembly of claim 3 wherein the swashplate assembly further includes a bearing located between the annular plate and the swashplate base allowing the annular plate to rotate relative to the swashplate base.

5. The assembly of claim 3 wherein a contact between the piston and the annular plate has a characteristic circular footprint on the piston.

6. The assembly of claim 1 wherein the piston has a ball-joint-like surface and the rocker arm has a fork extending around the ball-joint-like surface of the piston.

7. The assembly of claim 6 wherein the ball-joint-like surface on the piston has a generally spherical radius profile.

8. The assembly of claim 7 wherein the piston has a convex end surface.

9. The assembly of claim 8 wherein the convex end surface has a generally spherical profile with a radius greater than a radius of the ball-joint-like surface.

10. The assembly of claim 9 wherein the piston has a cylindrical surface connecting the convex end surface and the ball-joint-like surface.

11. The assembly of claim 7 wherein the piston has a main cylindrical body with a cone shaped surface spaced apart from and facing the ball-joint-like surface.

12. The assembly of claim 11 wherein the cone shaped surface is connected to the ball-joint-like surface by a concave cylindrical neck portion.

13. The assembly of claim 7 wherein the fork of the rocker arm has a first face with a generally spherical radius profile directed towards and corresponding to the profile of the ball-joint-like surface of the piston.

14. The assembly of claim 13 wherein the fork of the rocker arm has a second face directed toward a cone shape surface of the piston and wherein the second face of the fork of the rocker arm has a pair of ramps extending out of the second face, with each of the pair of ramps located on opposite lateral sides of the fork limiting the lateral angular misalignment of the piston with the rocker arm.

15. The assembly of claim 14 wherein the ramps limit the lateral angular misalignment between the piston and rocker arm to about 2 degrees.

16. The assembly of claim 1 wherein the first and second directions are axial with respect to the piston, and wherein the assembly further comprises:

e. a sleeve bearing surrounding the piston and sized to permit the piston to have a slight radial movement in addition to the axial movement of the piston.

17. The assembly of claim 1 further comprising a cup-type seal received on the piston.

18. The assembly of claim 1 further comprising a spring acting against the rocker arm to urge the rocker arm and piston toward the swashplate.

19. The assembly of claim 18 wherein the spring is formed integrally with the rocker arm.

20. The assembly of claim 19 wherein the spring comprises at least one cantilevered finger on the rocker arm.

21. The assembly of claim 20 wherein the spring comprises two pairs of cantilevered fingers, with one pair of fingers located on each of opposite lateral sides of the rocker arm.

22. A piston pump assembly for pumping paint and similar liquid coatings comprising a. a source of rotary power;

b. a swashplate assembly connected for rotation to the source of rotary power;

c. a rocker arm in contact with the swashplate and arranged to reciprocate in a rocking motion as the swashplate rotates; and d. a piston in contact with the swashplate and connected to the rocker arm and arranged to reciprocate by action of the swashplate driving the piston in a first direction and by action of the rocker arm returning the piston in a second direction opposite to the first direction wherein the swashplate assembly includes a swashplate base and an annular plate contacting both the rocker arm and the piston in diametrically opposed regions; and wherein the rocker arm has a dome located at one of the diametrically opposed regions.

23. The assembly of claim 22 wherein a contact between the dome and the annular plate has a characteristic elongated footprint on the dome.

24. A piston pump assembly for pumping paint and similar liquid coatings comprising a. a source of rotary power;

b. a swashplate connected for rotation to the source of rotary power;

c. a rocker arm in contact with the swashplate and arranged to reciprocate in a rocking motion as the swashplate rotates; and d. a piston in contact with the swashplate and connected to the rocker arm and arranged to reciprocate by action of the swashplate driving the piston in a first direction and by action of the rocker arm returning the piston in a second direction opposite to the first direction wherein the piston has i. a ball-joint-like surface with a generally spherical radius profile and ii. a main cylindrical body with a cone shaped surface spaced apart from and facing the ball-joint-like surface; and wherein the rocker arm has a fork extending around the ball-joint-like surface of the piston and wherein the swashplate has a predetermined profile angle between an axis of rotation and a plane of a drive surface of the swashplate and the cone shaped surface of the piston has a cone angle substantially equal to the profile angle of the swashplate.

25. The assembly of claim 24 wherein the predetermined profile angle is about 8 degrees.

26. The assembly of claim 24 wherein the cone angle is about 8 degrees.

27. A piston pump assembly for pumping paint and similar liquid coatings comprising a. a source of rotary power;

b. a swashplate connected for rotation to the source of rotary power;

c. a rocker arm in contact with the swashplate and arranged to reciprocate in a rocking motion as the swashplate rotates;

d. a piston in contact with the swashplate and connected to the rocker arm and arranged to reciprocate by action of the swashplate driving the piston in a first direction and by action of the rocker arm returning the piston in a second direction opposite to the first direction; and e. a spring acting against the rocker arm to urge the rocker arm and piston toward the swashplate wherein the spring is a leaf spring separate from the rocker arm.

* * * * *